US011142295B2

(12) United States Patent
Sugiyama

(10) Patent No.: US 11,142,295 B2
(45) Date of Patent: Oct. 12, 2021

(54) OUTBOARD MOTOR

(71) Applicant: SUZUKI MOTOR CORPORATION, Hamamatsu (JP)

(72) Inventor: Shuichi Sugiyama, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 204 days.

(21) Appl. No.: 16/673,324

(22) Filed: Nov. 4, 2019

(65) Prior Publication Data

US 2020/0207452 A1 Jul. 2, 2020

(30) Foreign Application Priority Data

Dec. 26, 2018 (JP) ..... JP2018-242802

(51) Int. Cl.

| | |
|---|---|
| ***B63H 20/00*** | (2006.01) |
| ***F01M 11/02*** | (2006.01) |
| ***B63H 20/32*** | (2006.01) |
| *F01M 11/04* | (2006.01) |
| *B63H 20/10* | (2006.01) |

(52) U.S. Cl.

CPC ..... *B63H 20/002* (2013.01); *B63H 20/32* (2013.01); *F01M 11/02* (2013.01); *B63H 20/10* (2013.01); *F01M 11/0458* (2013.01)

(58) Field of Classification Search

CPC ..... B63H 20/002; B63H 20/32; B63H 20/10; F01M 11/02; F01M 11/0458; F01M 9/00

See application file for complete search history.

(56) References Cited

U.S. PATENT DOCUMENTS

2017/0113772 A1* 4/2017 Kumita ..... B63H 20/32
2019/0144093 A1* 5/2019 Kumita ..... B63H 20/002 440/88 L

FOREIGN PATENT DOCUMENTS

JP JP 2017-81372 A 5/2017

* cited by examiner

*Primary Examiner* — Syed O Hasan
(74) *Attorney, Agent, or Firm* — Stein IP, LLC

(57) ABSTRACT

There is provided an outboard motor. A first oil passage is provided in a lower case, extends upward from a front lower portion, and reaches a first connection position which is positioned above a height position of an anti-ventilation plate or at a front portion of a boundary portion between a middle case and the lower case. A second oil passage is provided in the lower case or at the boundary portion, extends rearward from the first connection position, and reaches a second connection position which is positioned at a rear upper portion or at the rear portion of the boundary portion. A first oil supply/discharge port is opened on a side surface of the rear upper portion of the lower case or on a side surface of the rear portion of the boundary portion, and communicates with the second oil passage at the second connection position.

10 Claims, 9 Drawing Sheets

OUTBOARD MOTOR

CROSS-REFERENCE TO RELATED APPLICATIONS

The disclosure of Japanese Patent Application No. 2018-242802 filed on Dec. 26, 2018, including specification, drawings and claims is incorporated herein by reference in its entirety.

TECHNICAL FIELD

The present disclosure relates to an outboard motor and, more specifically, to a structure for changing oil or the like for lubricating or cooling a gear mechanism or the like in an outboard motor.

BACKGROUND

Oil for lubricating or cooling a gear mechanism or the like is stored in a gear case provided in a lower unit of an outboard motor. Conventionally, in order to change this oil, it is necessary to remove the outboard motor from a boat hull and carry it on land while the boat hull floating on the water, or to unload the boat hull to which the outboard motor is attached. All of these operations take time and effort.

The following Patent Document 1 describes an outboard motor in which an oil passage connecting a gear chamber provided with a gear mechanism and a cowling provided with an engine is formed by a hose, a joint, or the like. Patent Document 1 describes that, in the outboard motor, oil change can be performed without removing the outboard motor from the boat hull while the boat hull floating on the water.

Patent Document 1: Japanese Patent Application Publication No. 2017-081372 A However, a lower unit of the outboard motor may be attached to and detached from a unit positioned above the lower unit in the outboard motor for replacement of parts or the like. As in the outboard motor described in Patent Document 1, in a case in which the hose serving as the oil passage is provided from the lower unit provided with the gear mechanism and the gear case to the upper unit provided with the engine or the like, it is difficult to attach and detach the lower unit.

That is, since the lower unit and the upper unit are connected by the hose, the hose must be removed in order to detach and separate the lower unit from the upper unit, which takes time and effort. In addition, in order to attach the temporarily removed lower unit to the upper unit, the temporarily removed hose must be reattached, and at this time, care must be taken so that the hose does not come loose and make strong contact with other parts, and the loose hose does not get stuck between the parts and get damaged, and the lower unit cannot be easily attached.

SUMMARY

It is at least one of objects of the present disclosure to provide an outboard motor which can improve a workability of oil change without making it difficult to attach and detach the lower unit.

According to an aspect of the embodiments of the present disclosure, there is provided an outboard motor comprising: an engine; a gear mechanism provided below the engine; a propeller provided behind the gear mechanism; a drive shaft connecting the engine and the gear mechanism; a propeller shaft connecting the gear mechanism and the propeller; an upper case accommodating the engine; a middle case accommodating an upper portion of the drive shaft; a lower case accommodating the lower portion of the drive shaft, the gear mechanism, and the propeller shaft, and storing oil; an anti-ventilation plate positioned above the propeller and provided in the lower case; a first oil passage provided in the lower case, extending upward from a front lower portion in the lower case, and reaching a first connection position which is positioned above a height position of the anti-ventilation plate in a front portion of the lower case or positioned at a front portion of a boundary portion between the middle case and the lower case; a second oil passage provided in the lower case or provided at the boundary portion between the middle case and the lower case, connected to the first oil passage at the first connection position, extending rearward from the first connection position, and reaching a second connection position which is positioned at a rear upper portion in the lower case or positioned at the rear portion of the boundary portion between the middle case and the lower case; and a first oil supply/discharge port opened on a side surface of the rear upper portion of the lower case or opened on a side surface of the rear portion of the boundary portion between the middle case and the lower case, and communicating with the second oil passage at the second connection position.

With the above configuration, it is possible to improve a workability of oil change without making it difficult to attach and detach the lower unit.

DETAILED DESCRIPTION OF THE EMBODIMENTS

Figure 1:
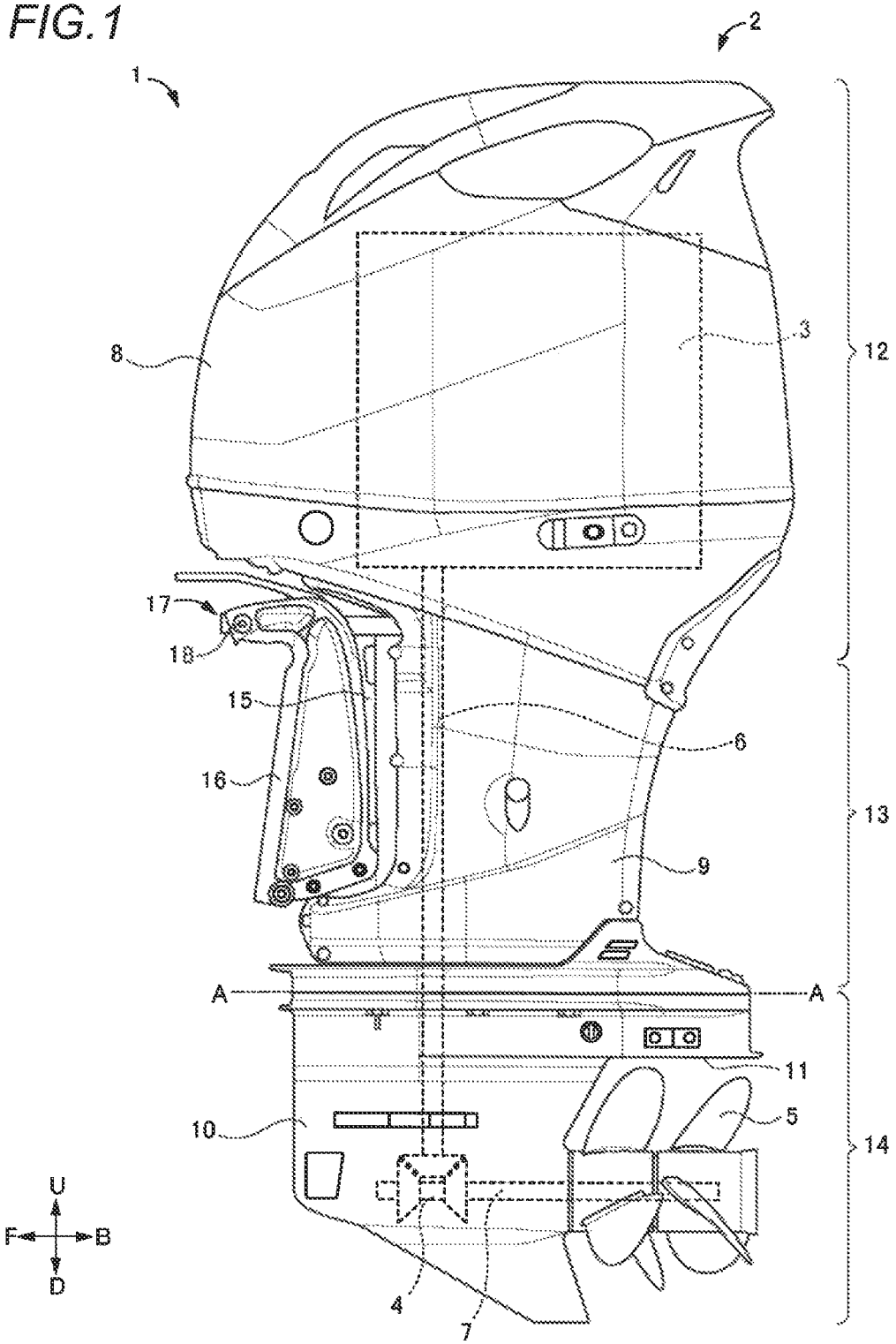
FIG. 1 is an explanatory view showing an entire outboard motor according to an embodiment of the present disclosure.

An outboard motor according to an embodiment of the present disclosure includes an engine, a gear mechanism provided below the engine, a propeller provided behind the gear mechanism, a drive shaft connecting the engine and the gear mechanism, a propeller shaft connecting between the gear mechanism and the propeller, an upper case accommodating the engine, a middle case accommodating an upper portion of the drive shaft, a lower case accommodating a lower portion of the drive shaft, the gear mechanism and the propeller shaft and storing oil, and an anti-ventilation plate positioned above the propeller and provided in the lower case.

The outboard motor according to the embodiment of the present disclosure includes a first oil passage, a second oil passage, and an oil supply/discharge port as a configuration for changing oil stored in the lower case.

The first oil passage is provided in the lower case and extends upward from a front lower portion in the lower case to reach a first connection position. The first connection position is positioned above a height position of the anti-ventilation plate in a front portion of the lower case or positioned at a front portion of a boundary portion between the middle case and the lower case.

The second oil passage is provided in the lower case or at the boundary portion between the middle case and the lower case, is connected to the first oil passage at the first connection position, and extends rearward from the first connection position to reach a second connection position. The second connection position is positioned at a rear upper portion in the lower case or positioned at the rear portion of the boundary portion between the middle case and the lower case.

The oil supply/discharge port is opened on a side surface of the rear upper portion of the lower case or opened on the side surface of the rear portion of the boundary portion between the middle case and the lower case, and communicates with the second oil passage at the second connection position.

In the outboard motor according to the embodiment of the present disclosure, when oil is changed, an operator first stops the boat hull on the water at a position adjacent to the land such as a wharf or a pier. Next, the operator tilts the outboard motor by, for example, about 45 degrees to 80 degrees with respect to the boat hull, and exposes at least a rear portion of the lower case of the outboard motor on the water. Subsequently, the operator connects, for example, a hose of a pump from the land to the oil supply/discharge port of the outboard motor. Thereafter, the operator sucks old oil stored in the lower case by the pump, and subsequently supplies new oil to the lower case.

In a state in which the outboard motor is tilted by, for example, about 45 degrees to 80 degrees with respect to the boat hull, the oil stored in the lower case collects in the front lower portion of the lower case. Therefore, a port of the first oil passage positioned at the front lower portion of the lower case reliably sinks into the oil. In addition, in the state in which the outboard motor is tilted by, for example, about 45 degrees to 80 degrees with respect to the boat hull, the oil supply/discharge port opened on the side surface of the rear upper portion of the lower case or on the side surface of the rear portion of the boundary portion between the middle case and the lower case comes to a hand reachable position from the land. Therefore, the operator can easily connect the hose or the like of the pump to the oil supply/discharge port. As described above, according to the outboard motor of the embodiment of the present disclosure, the oil change can be easily performed without removing the outboard motor from the boat hull while the boat hull floating on the water.

In the outboard motor according to the embodiment of the present disclosure, the first oil passage, the second oil passage, and the oil supply/discharge port are all disposed in the lower case or at the boundary portion between the middle case and the lower case. Therefore, the operator can easily attach and detach the lower case to and from the middle case. For example, the operator can detach and separate the lower case from the middle case without removing the hose or the like forming the first or second oil passage. In addition, since there is no need to reattach the hose or the like when the lower case is attached to the middle ease, the operator does not have to be concerned that the hose is loosened and strongly contacts with other parts, and the loose hose get stuck between the parts and be damaged.

Embodiment

Hereinafter, an embodiment of the outboard motor according to the present disclosure will be described. In the following description, when describing directions of front (Fr), rear (B), up/upper (U), down/lower (D), left (L), and right (R) regarding a configuration, an operation, or the like of the outboard motor, arrows shown at a lower portion of each figure are followed, FIG. 1 shows an outboard motor 1 according to an embodiment of the present disclosure. As shown in FIG. 1, the outboard motor 1 includes an outboard motor main body 2, a swivel bracket 15, a clamp bracket 16, and a tilt mechanism 17. The outboard motor main body 2 includes an engine 3, a gear mechanism 4 provided below the engine 3, a propeller 5 provided behind the gear mechanism 4, a drive shaft 6 extending in an up-down direction and connecting between the engine 3 and the gear mechanism 4, and a propeller shaft 7 extending in a front-rear direction and connecting between the gear mechanism 4 and the propeller 5. The drive shaft 6 is connected to a crankshaft of the engine 3. Power of the engine 3 is transmitted to the gear mechanism 4 via the drive shaft 6. The gear mechanism 4 includes a plurality of gears, and transmits the power of the engine 3 transmitted through the drive shaft 6 to the propeller 5 via the propeller shaft 7 by changing a rotational direction according to an operation of an operator.

The outboard motor main body 2 includes an engine cover 8 as an upper case accommodating the engine 3, a drive shaft housing 9 as a middle case accommodating an upper portion of the drive shaft 6, and a gear case 10 as a lower case accommodating a lower portion of the drive shaft 6, the gear mechanism 4, and the propeller shaft 7. In a rear portion of the gear case 10, an anti-ventilation plate 11 is provided above the propeller 5.

The outboard motor main body 2 includes an upper unit 12 positioned at an upper portion of the outboard motor main body 2 and including the engine 3 and the engine cover 8, and a middle unit 13 positioned below the upper unit 12 and including the drive shaft housing 9, and a lower unit 14 positioned below the middle unit 13 and including the drive shaft 6, the gear mechanism 4, the propeller 5, the propeller shaft 7, the gear case 10, and the anti-ventilation plate 11.

The swivel bracket 15 is a mechanism which supports the outboard motor main body 2 so as to be rotatable in a left-right direction so that a steering angle of the outboard motor main body 2 can be changed according to the steering. The clamp bracket 16 is a mechanism which fixes the outboard motor main body 2 and the swivel bracket 15 to a transom 82 of a boat hull 81 (see FIG. 7). The tilt mechanism 17 is a mechanism which tilts the outboard motor main body 2 with respect to the boat hull 81. The tilt mechanism 17 is formed by connecting the swivel bracket 15 to the clamp bracket 16 so as to be rotatable in the up-down direction via a tilt shaft 18.

Figure 2:
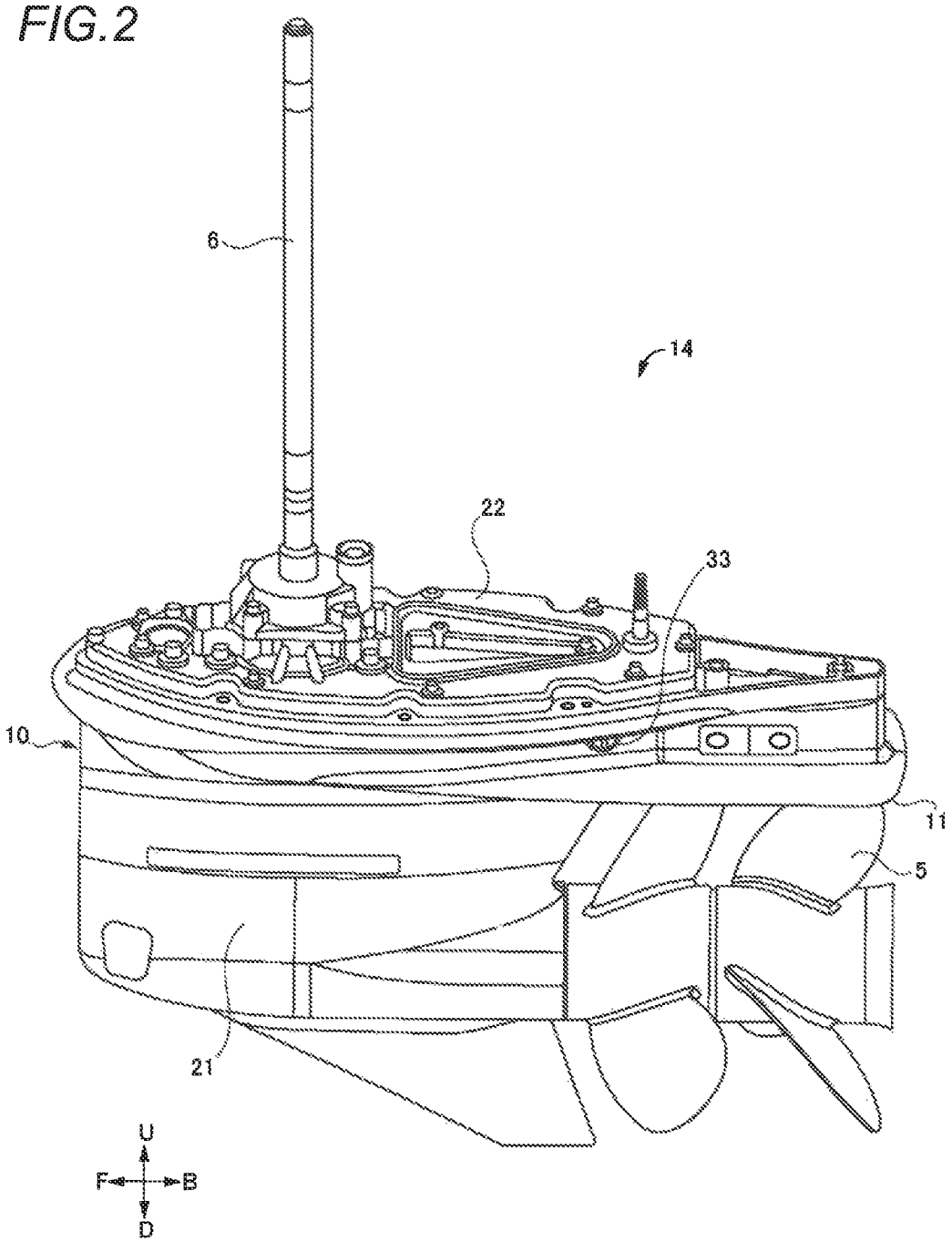
FIG. 2 is a perspective view showing a lower unit of an outboard motor main body of the outboard motor in FIG. 1.
Figure 3:
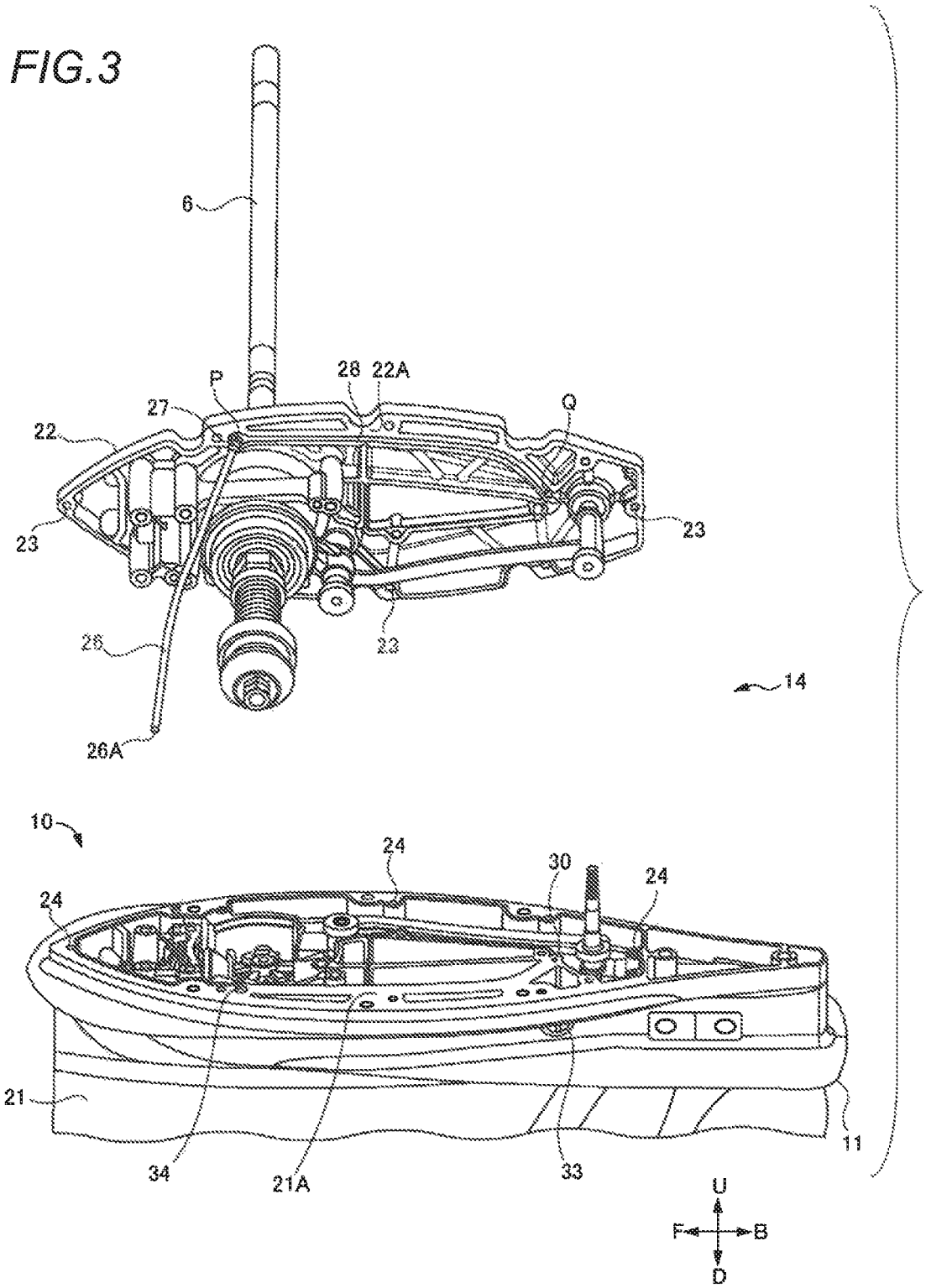
FIG. 3 is an explanatory view showing a state in which a gear case in the lower unit in FIG. 2 is disassembled into a case main body and a cover.

FIG. 2 shows the lower unit 14 of the outboard motor main body 2. FIG. 3 shows a state in which the gear case 10 is disassembled into a case main body 21 and a cover 22. As shown in FIG. 2, the lower unit 14 of the outboard motor main body 2 can be attached to and detached from the middle unit 13 mainly for maintenance such as replacement of parts. For example, the gear case 10 forming an outer shell of the lower unit 14 is fixed to a lower portion of the drive shaft housing 9 forming an outer shell of the middle unit. 13 using a fixing tool such as a bolt. By removing the fixing tool, the lower unit 14 can be separated from the middle unit 13. A two-dot chain line A-A in FIG. 1 shows a boundary between the middle unit 13 and the lower unit 14, that: is, a boundary between the drive shaft housing 9 and the gear case 10. At the boundary, the lower unit 14 and the middle unit 13 are separated from each other.

As shown in FIG. 3, the gear case 10 includes the case main body 21 and the cover 22. The case main body 21 is formed in a box shape with an open upper portion. The cover 22 is formed substantially in a plate shape, and is attached to the upper portion of the case main body 21 so as to close an opening portion of an upper portion of the case main body 21. In addition, mating surfaces 21A, 22A are formed on an upper surface of a periphery of the opening portion of the case main body 21 and a peripheral edge portion of a lower surface of the cover 22, respectively. A plurality of bolt insertion holes 23 are formed in the peripheral edge portion of the cover 22. A plurality of bolt tightening holes 24 are formed in a peripheral edge portion of the upper portion of the case main body 21. The cover 2 is attached to the case main body 21 by superimposing the mating surface 22A of the cover 22 on the mating surface 21A of the case main body 21, inserting bolts through the bolt insertion holes 23, and tightening the bolts to the bolt tightening holes 24. In addition, a seal member (not shown) seals between the case main body 21 and the cover 22.

Figure 4:
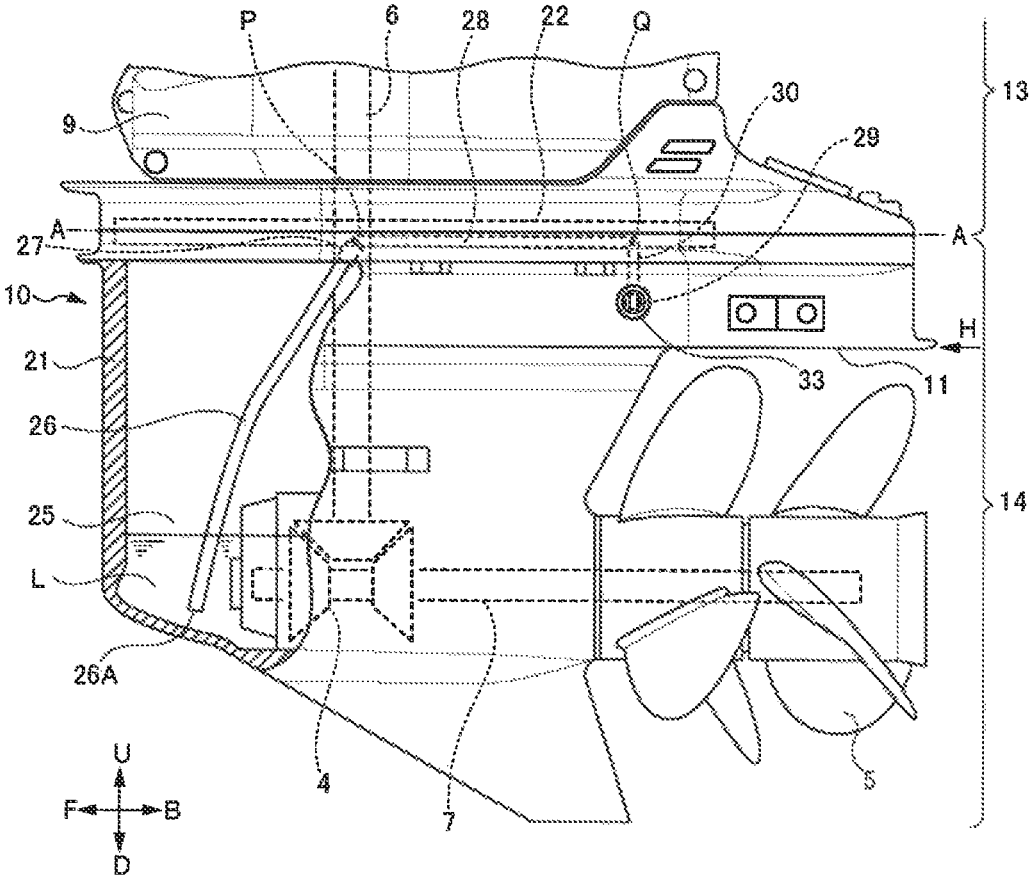
FIG. 4 is an explanatory view showing an oil supply/discharge mechanism of the outboard motor according to the embodiment of the present disclosure.

FIG. 4 shows an oil supply/discharge mechanism of the outboard motor 1. The outboard motor 1 includes the oil supply/discharge mechanism. The oil supply/discharge mechanism is a mechanism for discharging oil for lubricating or cooling a gear or the like of the gear mechanism 4 from an oil storage chamber 25 in the gear case 10 or supplying the oil to the oil storage chamber 25. As shown in FIG. 4, the oil supply/discharge mechanism is provided in the lower unit 14. The oil supply/discharge mechanism has an oil tube 26 as a first oil passage, an oil groove 28 as a second oil passage, an oil hole 30, and an oil supply/discharge port 29.

FIG. 4 shows the inside of a front portion of the gear case 10 by breaking a part of a wall portion of the gear case 10. As shown in the figure, the oil storage chamber 25 is provided in the gear case 10. In the present embodiment, almost the entire area inside the gear case 10 functions as the oil storage chamber 25. Oil L for lubricating or cooling a gear or the like provided in the gear mechanism 4 is stored in the oil storage chamber 25.

The oil tube 26 is provided inside the front portion of the gear case 10. An opening portion 26A at one end side of the oil tube 26 is positioned in a front lower portion of the gear case 10. Specifically, the opening portion 26A at one end side of the oil tube 26 is positioned in front of the gear mechanism 4. The oil tube 26 extends upward from a front lower portion in the gear case 10, and an opening portion on the other end side of the oil tube 26 reaches a first connection position P. The first connection position P is positioned above a height position H of the anti-ventilation plate 11 at the front portion in the gear case 10. As shown in FIG. 3, the first connection position P is positioned on the left side of the drive shaft 6.

The oil tube 26 is formed by, for example, a resin material in a tubular shape, and both ends thereof are open. In addition, a connection member 27 for connecting the oil tube 26 to a front end portion of the oil groove 28 is attached to the other end portion (upper end portion) of the oil tube 26. The connection member 27 is formed in an annular shape by an elastic material such as rubber, and is mounted on an outer peripheral side of the other end portion of the oil tube 26.

FIG. 3 shows a state in which the cover 22 of the gear case 10 is viewed from a left-obliquely lower side. As shown in FIG. 3, the oil groove 28 is formed on a lower surface of the cover 22. Specifically, the oil groove 28 is formed on a part of the mating surface 22A of the cover 22. By attaching the cover 22 to the case main body 21, a downward opened portion of the oil groove 28 is closed by the mating surface 21A of the case main body 21, and a hole-like passage is formed between the case main body 21 and the cover 22.

The oil groove 28 extends rearward from the first connection position P, and reaches a second connection position Q positioned on a rear upper portion of the gear case 10. The second connection position Q is positioned above the anti-ventilation plate 11 and behind the drive shaft 6. In addition, the oil groove 28 is disposed on a left portion of the gear ease 10. The other end portion of the oil tube 26 is connected to the front end portion of the oil groove 28 positioned at the first connection position P via the connection member 27, and the inside of the oil tube 26 and the inside of the oil groove 28 communicate with each other at this position. Specifically, as shown in FIG. 3, in the mating surface 21A of the case main body 21, a connection hole 34 is formed at a position facing the front end portion of the oil groove 28. The connection hole 34 is a short hole extending in the up-down direction. An upper end side of the connection hole 34 is opened on the mating surface 21A, and a lower end side of the connection hole 34 is open in the oil storage chamber 25. The other end side of the oil tube 26 is connected to the front end portion of the oil groove 28 through the connection hole 34.

As shown in FIG. 4, the oil supply/discharge port 29 is opened on a left surface of a left wall portion of the rear upper portion of the case main body 21. The oil supply/discharge port 29 is disposed above the anti-ventilation plate 11, below the second connection position Q, and behind the drive shaft 6. In the present embodiment, a position of the oil supply/discharge port 29 is below the second connection position Q in a vertical direction. In addition, in the present embodiment, a position of the oil supply/discharge; port 29 in the front-rear direction is substantially a position corresponding to a base end portion of the propeller 5.

The oil hole 30 is a passage which allows the rear end portion of the oil groove 28 positioned at the second connection position Q to communicate with the oil supply/discharge port 29. The oil hole 30 extends in the up-down direction substantially linearly from the second connection position Q to the oil supply/discharge port 29.

Figure 5:
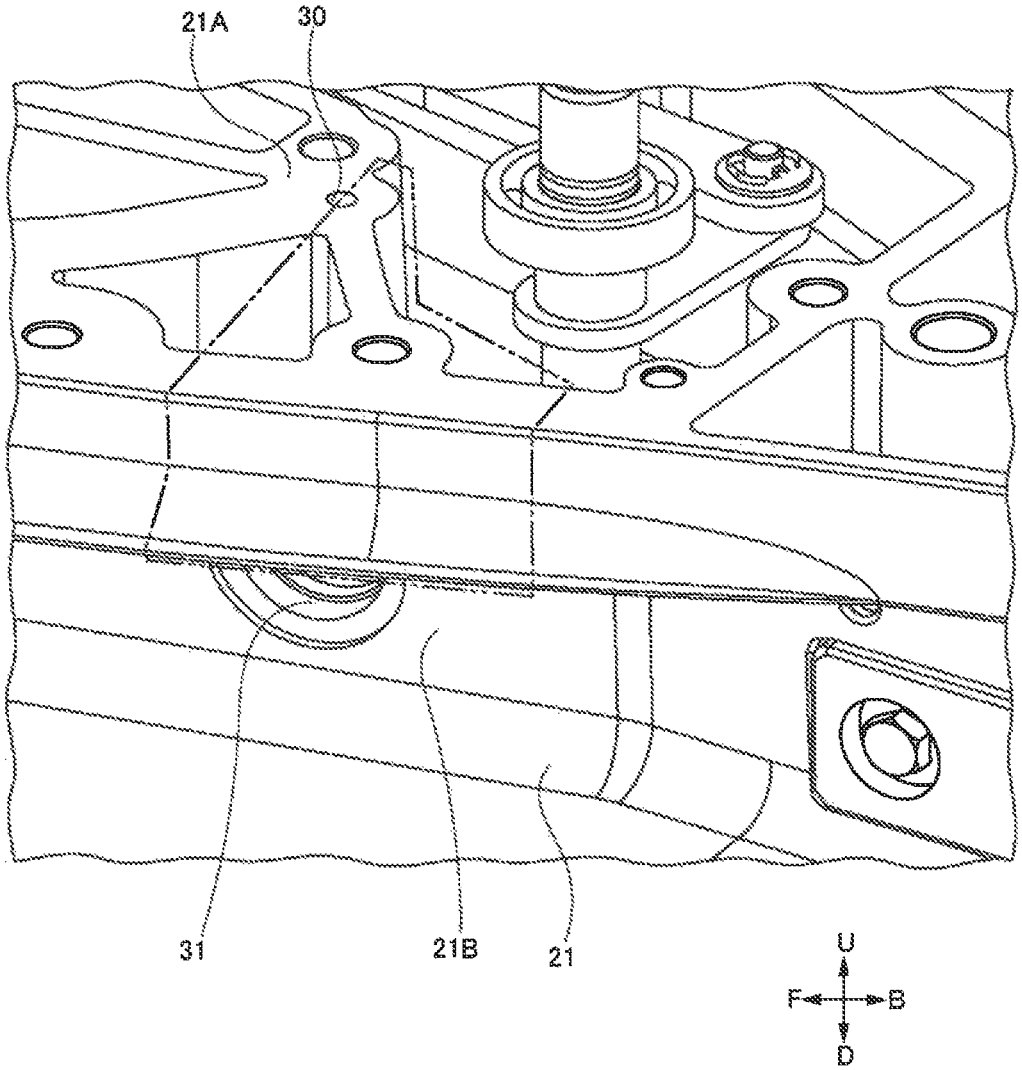
FIG. 5 is an enlarged view showing a rear upper portion of the gear case in the outboard motor according to the embodiment of the present disclosure.
Figure 6:
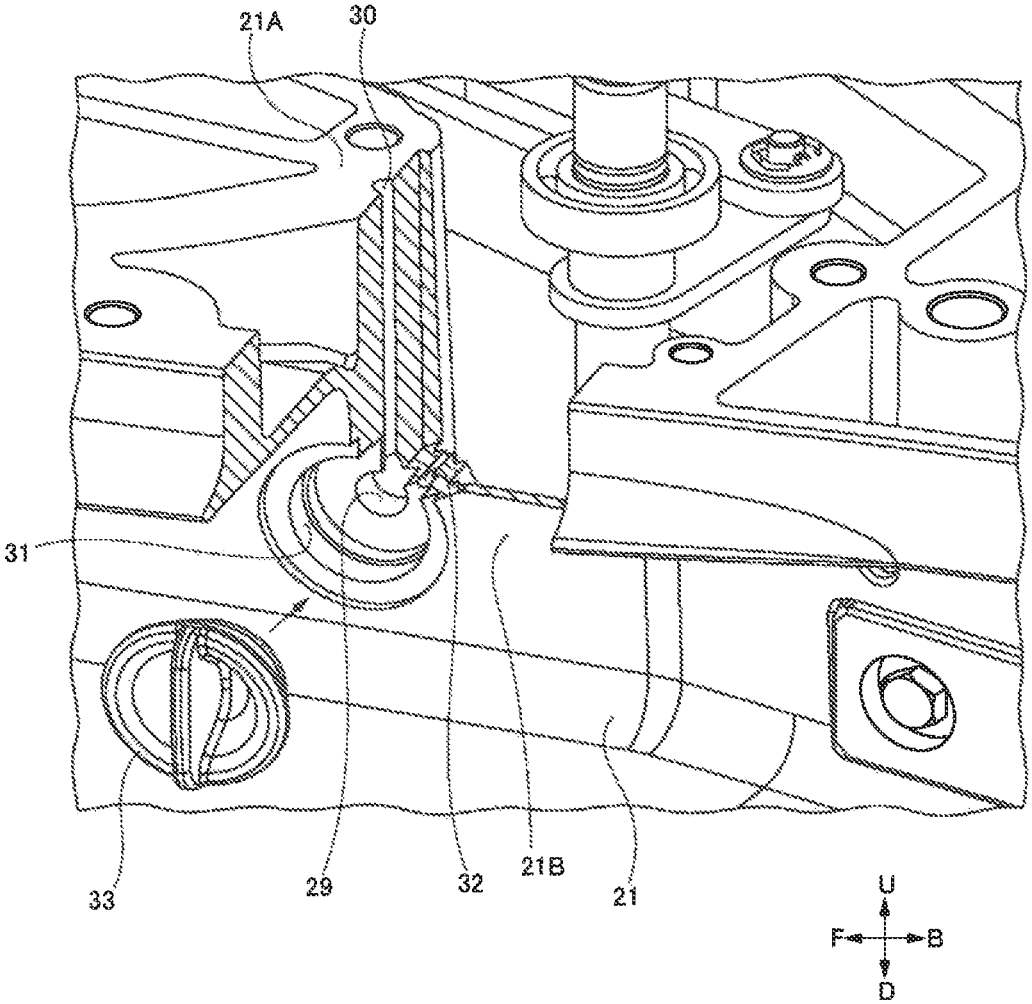
FIG. 6 is a sectional view showing a cross section of a portion surrounded by a two-dot chain line at the rear upper portion of the gear case in FIG. 5.

FIG. 5 shows a portion where the oil supply/discharge port 29 and the oil hole 30 are formed in the rear upper portion of the case main body 21 of the gear case 10, FIG. 6 shows a cross section of the portion surrounded by a two-dot chain line in FIG. 5. As shown in FIG. 6, the oil hole 30 is a hole formed in a left wall portion 21B of the rear upper portion of the case main body 21. An upper end side of the oil hole 30 is opened at a position facing the rear end portion of the oil groove 28 positioned at the second connection position Q on the mating surface 21A of the case main body 21, and communicates with the rear end portion of the oil groove 28. A lower end side of the oil hole 30 communicates with the oil supply/discharge port 29. The oil supply/discharge port 29 is a bottomed hole formed on the left surface of the left wall portion 21B of the rear upper portion of the case main body 21. A lower end side of the oil hole 30 is open at an upper portion of an inner peripheral surface of a bottom side of the bottomed hole.

As shown in FIG. 6, in the left surface of the left wall portion 21B of the rear upper portion of the case main body 21, a recess 31 having a circular opening shape is formed at a position corresponding to the oil supply/discharge port 29. The oil supply/discharge port 29 is formed on the recess 31, and specifically, is opened at a center of a bottom surface of the recess 31. In addition, an air hole 32 is formed in the recess 31 at a position adjacent to the oil supply/discharge port 29. The air hole 32 extends linearly rightward from the bottom surface of the recess 31, penetrates the wall portion 21B, and communicates with the inside of the gear case 10 (inside the oil storage chamber 25). A plug 33 is attached to the recess 31, and the oil supply/discharge port 29 and the air hole 32 are closed by the plug 33. The plug 33 is provided with a seal member, and the oil supply/discharge port 29 and the air hole 32 are sealed by the plug 33 being attached to the recess 31. The plug 33 can be removed from the recess 31 in order to discharge or supply oil.

Figure 7:
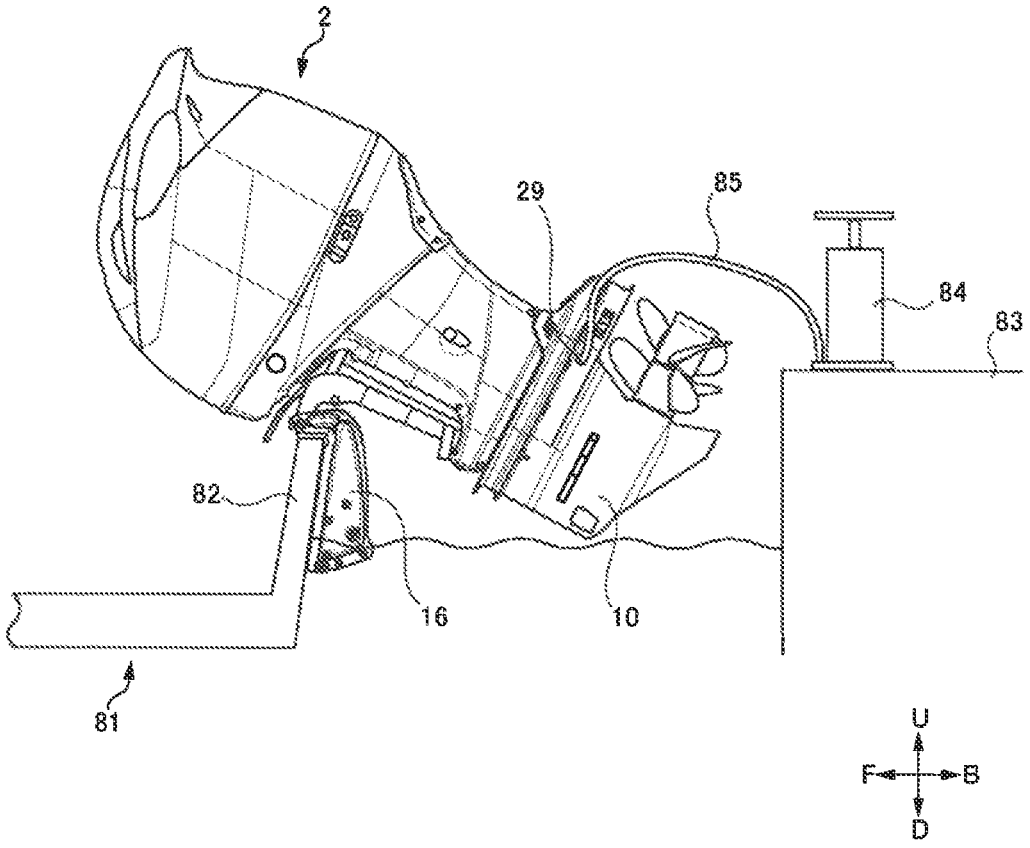
FIG. 7 is an explanatory view showing a method of oil change of the outboard motor according to the embodiment of the present disclosure.

FIG. 7 shows a method of the oil change of the outboard motor 1. The operator can change the oil (oil discharge and supply) as follows. In FIG. 7, the operator first stops the boat hull 81 on the water at a position adjacent to a land 83 such as a wharf or a pier. Next, the operator tilts the outboard motor 1 by, for example, about 45 degrees to 80 degrees with respect to the boat hull 81, and exposes at least a rear portion of the lower unit 14 of the outboard motor 1 an the water. Subsequently, the operator removes the plug 33 and connects a hose 85 of a pump 84 for both suction and pressurization from above the land 83 to the oil supply/discharge port 29 of the outboard motor 1, for example. In this state, the operator can suck and discharge old oil stored in the oil storage chamber 25 by using the pump 84. In addition, after the oil is discharged, the operator can supply new oil to the oil storage chamber 25 by using the pump 84.

As shown in FIG. 4, at the time of oil discharge, the oil stored in the oil storage chamber 25 flows into the oil tube 26 from the opening portion 26A at one end side of the oil tube 26, flows into the oil groove 28 from the front end portion of the oil groove 28 after flowing through the oil tube 26, flows into the oil hole 30 from the rear end portion of the oil groove 28 after flowing through the oil groove 28, and flows out from the oil supply/discharge port 29 into the hose 85 of the pump 84 connected to the oil supply/discharge port 29 after flowing through the oil hole 30. In addition, when the oil is discharged, the outside air flows into the oil storage chamber 25 from the air hole 32, and a pressure in the oil storage chamber 25 is adjusted.

At the time of oil supply, the oil flowing into the oil supply/discharge port 29 from the hose 85 of the pump 84 connected to the oil supply/discharge port 29 flows into the oil storage chamber 25 through a path reverse to that at the time of the oil discharge. In addition, when oil is supplied, the air in the oil storage chamber 25 is discharged to the atmosphere via the air hole 32, and the pressure in the oil storage chamber 25 is adjusted.

As described above, in the outboard motor 1 according to the embodiment of the present disclosure, the opening portion 26A at one end side of the oil tube 26 in the oil supply/discharge mechanism is disposed in a front lower portion of the gear case 10. Specifically, the opening portion 26A on one end side of the oil tube 26 is disposed in a position in front of the gear mechanism 4 in the gear case. According to this configuration, when the outboard motor 1 is tilted by, for example, about 45 degrees to 80 degrees with respect to the boat hull 81, the opening portions 26A at one end side of the oil tube 26 can be reliably sunk in the oil collected in the front lower portion of the gear case 10, that is, in a front lower portion of the oil storage chamber 25. Therefore, when the oil stored in the oil storage chamber 25 is sucked by the pump, the oil can be reliably made to flow into the oil tube 26. In addition, in the outboard motor 1 of the embodiment of the present disclosure, the oil supply/discharge port 29 is disposed on a side surface of the rear upper portion of the gear case 10. Specifically, the oil supply/discharge port 29 is disposed above the anti-ventilation plate 11 and behind the drive shaft 6. According to this configuration, when the outboard motor 1 is tilted by, for example, about 45 degrees to 80 degrees with respect to the boat hull 81, and at least the rear portion of the lower unit 14 of the outboard motor 1 is exposed on the water, the oil supply/discharge port 29 can be positioned at a position where a hand of the operator on the land of the wharf, the pier, or the like can reach. Therefore, the operator can easily connect the oil hose to the oil supply/discharge port 29. As described above, according to the outboard motor 1 of the embodiment of the present disclosure, the operator can easily perform the oil change while the boat hull floating on the water.

According to the outboard motor 1 of the embodiment of the present disclosure, all the components configuring the oil supply/discharge mechanism, that is, the oil tube 26, the oil groove 28, the oil hole 30, and the oil supply/discharge port 29 are formed in the gear case 10. With this configuration, the operator can easily attach and detach the lower unit 14 to and from the middle unit 13. That is, in order to detach and separate the lower unit from the upper unit in the outboard motor described in Patent Document 1 described above, it is necessary to take time and effort to remove the hose as the oil passage. However, according to the outboard motor 1 of the embodiment of the present disclosure, there is no need to detach and separate the lower unit and to remove the hose or the like. In addition, in the outboard motor described in Patent Document 1 described above, in order to attach the temporarily removed lower unit to the upper unit, the temporarily removed hose must be reattached, and at this time, care must be taken so that the hose does not come loose and make strong contact with other parts, and the loose hose does not get stuck between the parts and get damaged. However, according to the outboard motor 1 of the embodiment of the present disclosure, there is no need to attach the temporarily removed lower unit to the upper unit and to reattach the hose or the like.

According to the outboard motor 1 of the embodiment of the present disclosure, the oil tube 26 is disposed from the front lower portion in the gear case 10 to the first connection position P which is positioned above the height position H of the anti-ventilation plate 11 at the front portion of the gear case 10, and the oil groove 28 is disposed between the first connection position P and the second connection position Q at the rear upper portion of the gear case 10. Specifically, the first connection position P is positioned at the lateral side of the drive shaft 6, and the second connection position Q is positioned above the anti-ventilation plate 11 and behind the drive shaft 6. With this configuration, it is possible to easily avoid that the oil passage forming the oil supply/discharge mechanism interferes with other parts of the outboard motor 1, for example, the gear mechanism 4, the drive shaft 6, or the like.

In the outboard motor 1 according to the embodiment of the present disclosure, the first oil passage is formed by the oil tube 26. In the outboard motor 1 according to the embodiment of the present disclosure, the second oil passage is formed by the oil groove 28 provided in the cover 22 of the gear case 10. With this configuration, a structure of the oil supply/discharge mechanism can be simplified.

According to the outboard motor 1 of the embodiment of the present disclosure, the recess 31 is formed in the side surface of the rear upper portion of the gear case 10, the oil supply/discharge port 29 and the air hole 32 are disposed on the recess 31, and the plug 33 configured to close the opening portion of the recess 31 is provided. With this configuration, the oil supply/discharge port 29 and the air hole 32 can be simultaneously closed only by attaching the single plug 33 to the recess 31. In addition, the oil supply/discharge port 29 and the air hole 32 can be opened only by removing the single plug 33. Therefore, the attaching and detaching of the plug 33 is performed only once, and a workability is good.

In the outboard motor 1 of the embodiment described above, as shown in FIG. 4, the first connection position P is positioned above the height position H of the anti-ventilation plate 11 at the front portion of the gear case 10. However, as in an outboard motor 41 of another embodiment shown in FIG. 8, a first connection position R may be positioned at a front portion of the boundary portion between the drive shaft housing 9 and the gear case 10.

In the outboard motor 1 of the embodiment described above, as shown in FIG. 4, the second connection position Q is positioned at the rear upper portion of the gear case 10. However, as in the outboard motor 41 of the other embodiment shown in FIG. 8, a second connection position S may be positioned at a rear portion of the boundary portion between the drive shaft housing 9 and the gear case 10.

In the outboard motor 1 of the embodiment described above, as shown in FIG. 4, the oil groove 28 as the second oil passage is formed on the mating surface 22A of the lower surface of the cover 22 of the gear case 10, and a portion opened downward of the oil groove 28 is closed by the mating surface 21A of the case main body 21. However, as in the outboard motor 41 of the other embodiment shown in FIG. 8, an oil groove 42 may be formed on a lower surface of the drive shaft housing 9, and a portion opened downward of the oil groove 42 may be closed by an upper surface of the gear case 10 overlapping a lower surface of the drive shaft housing 9. Although not shown, the oil groove may be formed on the upper surface of the gear case 10, and a portion opened upward of the oil groove may be closed by the lower surface of the drive shaft housing 9 overlapping the upper surface of the gear case 10.

Figure 8:
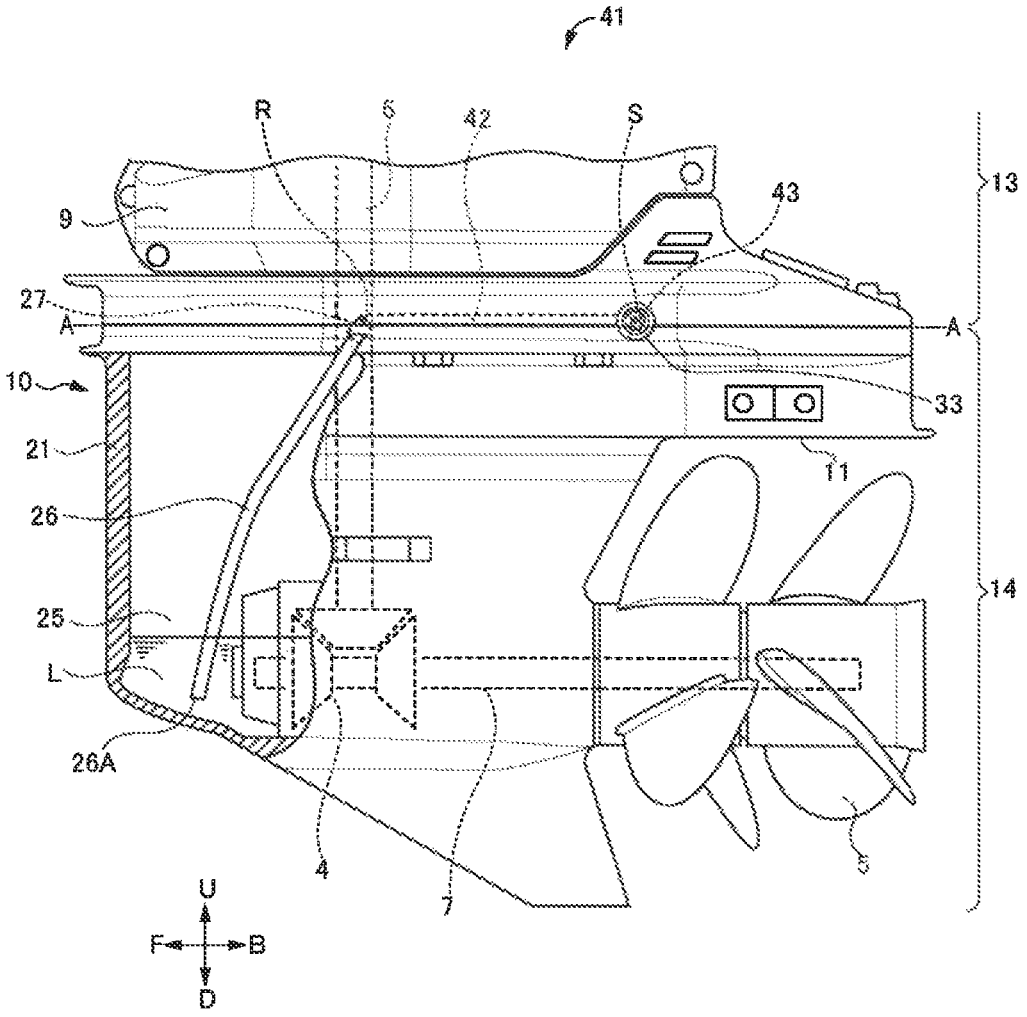
FIG. 8 is an explanatory view showing an oil supply/discharge mechanism of an outboard motor according to another embodiment of the present disclosure.

In the outboard motor 1 of the embodiment described above, as shown in FIG. 4, the oil supply/discharge port 29 is disposed on the side surface of the rear upper portion of the gear case 10, but as in the outboard motor 41 of the other embodiment shown in FIG. 8, an oil supply/discharge port 43 may be disposed on the side surface of the rear portion of the boundary portion between the drive shaft housing 9 and the gear case 10.

Figure 9:
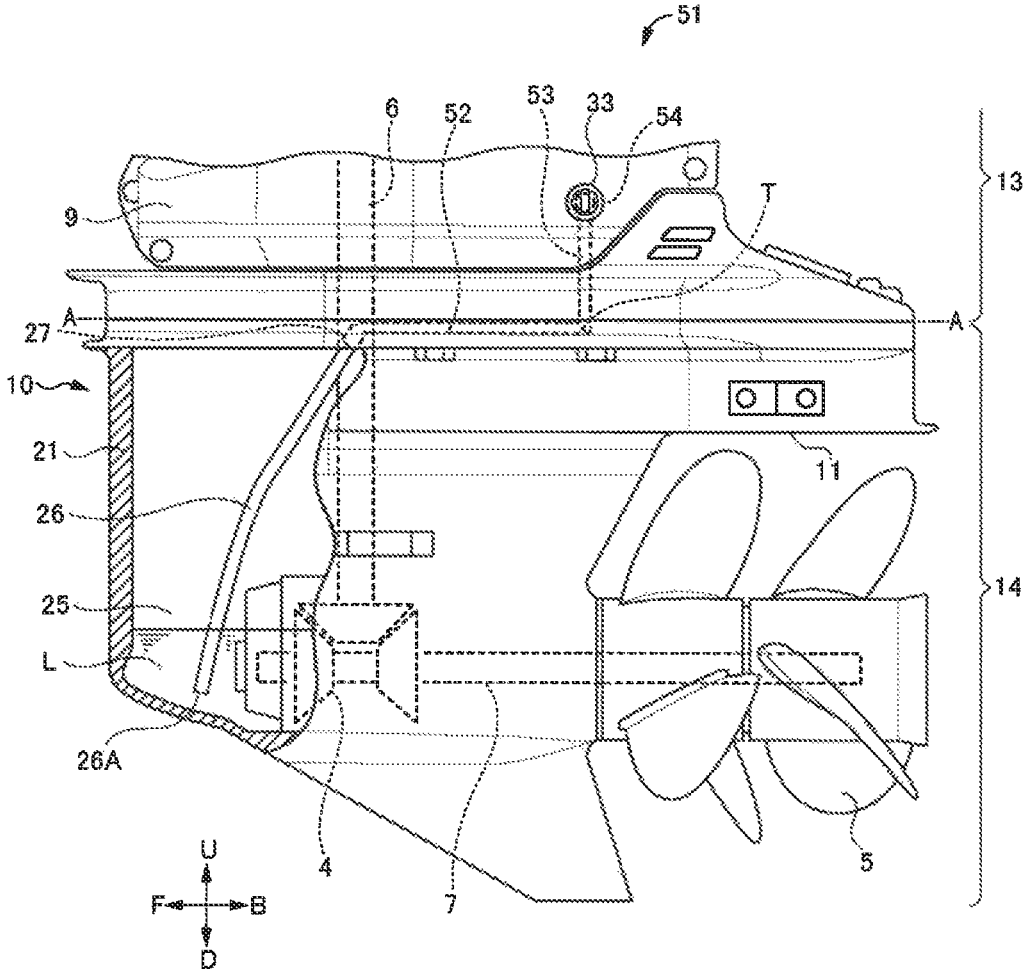
FIG. 9 is an explanatory view showing an oil supply/discharge mechanism of an outboard motor according to still another embodiment of the present disclosure.

As in an outboard motor 51 of still another embodiment shown in FIG. 9, an oil supply/discharge port 54 (second oil supply/discharge port) may be disposed so as to open on the side surface of the rear lower portion of the drive shaft housing 9, and a third oil passage 53 may be provided to connect a second oil passage 52 and the oil supply/discharge port 54. In this case, in order to prevent difficulty in attaching and detaching the lower unit 14 to and from the middle unit 13, for example, it is preferable that the second oil passage 52 is formed by a groove provided on the upper surface of the gear case 10, an opening on a lower end side of the third oil passage 53 is formed on the lower surface of the drive shaft housing 9, and only by attaching the gear case 10 to the drive shaft housing 9, at a connection position T which is positioned at the same position as the second connection position Q or S, a rear end portion of the second oil passage 52 and the opening on the lower end side of the third oil passage 53 are overlapped with each other in a state in which they face each other, and communicate with each other.

In the embodiment described above, a case in which the outboard motor main body 2 includes three units of the upper unit 12, the middle unit 13 and the lower unit 14 is taken as an example, but the outboard motor main body may include two units of a lower unit and a single unit above the lower unit.

In the embodiment described above, the oil tube 26, the oil groove 28, and the oil supply/discharge port 29 are disposed on the left portion of the gear case 10, but they may be disposed on a right portion of the gear case 10. In addition, the oil supply/discharge port 29 may be disposed on a rear surface of the upper portion of the gear case 10.

In the outboard motor, the first oil passage is not limited to the tube, and may be a hose, a pipe, or a hole in the wall portion of the gear case. The second oil passage is not limited to the groove, and may be a tube, a hose, a pipe, or a hole in the wall portion of the gear case.

The present disclosure can be modified as appropriate without departing from the scope or spirit of the invention which can be read from the claims and the entire specification, and the outboard motor accompanying such a change is also included in the technical concept of the present disclosure.

What is claimed is:

1. An outboard motor comprising:

an engine;

a gear mechanism provided below the engine;

a propeller provided behind the gear mechanism;

a drive shaft connecting the engine and the gear mechanism;

a propeller shaft connecting the gear mechanism and the propeller;

an upper case accommodating the engine;

a middle case accommodating an upper portion of the drive shaft;

a lower case accommodating the lower portion of the drive shaft, the gear mechanism, and the propeller shaft, and storing oil;

an anti-ventilation plate positioned above the propeller and provided in the lower case;

a first oil passage provided in the lower case, extending upward from a front lower portion in the lower case, and reaching a first connection position which is positioned above a height position of the anti-ventilation plate in a front portion of the lower case or positioned at a front portion of a boundary portion between the middle case and the lower case;

a second oil passage provided in the lower case or provided at the boundary portion between the middle case and the lower case, connected to the first oil passage at the first connection position, extending rearward from the first connection position, and reaching a second connection position which is positioned at a rear upper portion in the lower case or positioned at the rear portion of the boundary portion between the middle case and the lower case; and a first oil supply/discharge port opened on a side surface of the rear upper portion of the lower case or opened on a side surface of the rear portion of the boundary portion between the middle case and the lower case, and communicating with the second oil passage at the second connection position.

2. The outboard motor according to claim 1, wherein the first oil passage extends from a position in front of the gear mechanism.

3. The outboard motor according to claim 1, wherein the first connection position is positioned at a lateral side of the drive shaft.

4. The outboard motor according to claim 1, wherein the second connection position is positioned above the anti-ventilation plate and behind the drive shaft.

5. The outboard motor according to claim 1, wherein the first oil supply/discharge port is positioned above the anti-ventilation plate and behind the drive shaft.

6. The outboard motor according to claim 1, wherein the first oil passage is formed by a tube, a hose, or a pipe.

7. The outboard motor according to claim 1, wherein the second oil passage is formed by a tube, a hose, or a pipe.

8. The outboard motor according to claim 1, wherein the second oil passage is formed by a hole or groove provided in a wall portion of the lower case, a groove provided on an upper surface of the lower case, or a groove provided on a lower surface of the middle case.

9. The outboard motor according to claim 1, wherein a recess is formed on the side surface of the rear upper portion of the lower case or formed on the side surface of the rear portion of the boundary portion between the middle case and the lower case, wherein an air hole communicating with the first oil supply/discharge port and the lower case is disposed in the recess, and wherein the outboard motor further comprises a plug for closing an opening portion of the recess.

10. An outboard motor comprising: an engine; a gear mechanism provided below the engine; a propeller provided behind the gear mechanism; a drive shaft connecting the engine and the gear mechanism; a propeller shaft connecting the gear mechanism and the propeller; an upper case accommodating the engine; a middle case accommodating an upper portion of the drive shaft; a lower case accommodating the lower portion of the drive shaft, the gear mechanism, and the propeller shaft, and storing oil; an anti-ventilation plate positioned above the propeller and provided in the lower case; a first oil passage provided in the lower case, extending upward from a front lower portion in the lower case, and reaching a first connection position which is positioned above a height position of the anti-ventilation plate in a front portion of the lower case or positioned at a front portion of a boundary portion between the middle case and the lower case; a second oil passage provided in the lower case or provided at the boundary portion between the middle case and the lower case, connected to the first oil passage at the first connection position, extending rearward from the first connection position, and reaching a second connection position which is positioned at a rear upper portion in the lower case or positioned at the rear portion of the boundary portion between the middle case and the lower case; a supply/discharge port opened on a side surface of a rear lower portion of the middle case; and a third oil passage connecting the second oil passage and the oil supply/discharge port.

* * * * *